United States Patent [19]

Tucker et al.

[11] 4,176,525

[45] Dec. 4, 1979

[54] COMBINED ENVIRONMENTAL AND REFRIGERATION SYSTEM

[75] Inventors: James M. Tucker; Roger W. Dougan; Jackob Swartzon, all of San Antonio, Tex.

[73] Assignee: Wylain, Inc., Dallas, Tex.

[21] Appl. No.: 862,968

[22] Filed: Dec. 21, 1977

[51] Int. Cl.[2] ..... F25B 27/02; F25B 29/00; F25D 17/00; F25B 7/00

[52] U.S. Cl. ..... 62/238 R; 62/159; 62/196 B; 62/333; 62/335

[58] Field of Search ..... 62/159, 196 B, 238 A, 62/238 B, 238 C, 238 D, 238 E, 238 R, 160, 173, 411, 333, 335; 165/59, 30

[56] References Cited

U.S. PATENT DOCUMENTS

| | | | |
|---|---|---|---|
| 2,100,834 | 11/1937 | Chapman | 62/411 |
| 2,497,028 | 2/1950 | Kirkpatrick | 62/159 |
| 2,752,759 | 7/1956 | Sperzel | 62/159 |
| 2,755,072 | 7/1956 | Kreuttner | 165/59 |
| 3,185,209 | 5/1965 | Quick | 165/30 |
| 3,299,651 | 1/1967 | McGrath | 62/238 D |
| 3,357,199 | 12/1967 | Harnish | 62/196 B |
| 3,481,152 | 12/1969 | Seeley | 62/196 B |
| 3,540,526 | 11/1970 | Hoaglund et al. | 165/22 |
| 3,921,413 | 11/1975 | Kohlbeck | 62/173 |
| 4,034,801 | 7/1977 | Bernstein | 165/59 |

*Primary Examiner*—Lloyd L. King
*Attorney, Agent, or Firm*—Lane, Aitken & Ziems

[57] ABSTRACT

A combined environmental and refrigeration system for use in a supermarket or the like includes a plurality of environmental and refrigeration modules and controllable air flow dampers to provide selected air flow modes to a conditioned space. Each module includes a hot deck compartment having a fan and the condenser portion of a refrigeration system to heat an air flow through the hot deck compartment, and a cold deck compartment having the evaporator portion of an air conditioning system to cool the air supplied to the conditioned space. At least a portion of the condenser in one of the hot deck compartments is provided to sub-cool the refrigeration system working fluid.

The various fans, evaporators, condensers, and dampers are controlled by suitable control means to provide a conditioned space dehumidification mode, and a plurality of conditioned space cooling and heating modes. The system permits precise four season environmental control of the conditioned space while increasing the efficiency of the refrigeration system by reclaiming the heat rejected by the refrigeration cycle and sub-cooling the refrigeration system working fluid during the dehumidification and heating modes.

17 Claims, 10 Drawing Figures

COMBINED ENVIRONMENTAL AND REFRIGERATION SYSTEM

BACKGROUND OF THE INVENTION

The present invention relates to combined environmental and refrigeration systems suitable for use in supermarkets, or the like, and, more particularly, to increased efficiency systems with means to reclaim heat from the refrigeration system and sub-cool the refrigeration system working fluid.

Supermarkets, and the like, generally include both a refrigeration system for refrigerating the interior of display cases and freezers, and a separate environmental system for heating, cooling, dehumidifying, and otherwise conditioning the interior environmental space of the supermarket. Traditionally, the refrigeration system includes a centrally located equipment room containing compressors, condensers, fans, and blowers with pipes to conduct the pressurized working fluid through evaporator coils located in various display cases and freezers. The environmental system, which may be a reversible heat pump, is usually a centrally located self-contained unit with space air inlet and return ducts opening into the conditioned space of the supermarket.

When the environmental system is in its heating mode, the efficiency of both the environmental and refrigeration system has been increased by diverting a portion of the hot refrigeration system working fluid through one or more heat reclaiming coils located in the environmental system ducts. While the heat reclaimed thereby increases the overall efficiency of the systems, the increase is available only when the environmental system is in the heating mode and requires additional working fluid pipes, valves, and one or more heat reclaiming coils. As can be appreciated, the increased capitol and maintenance costs associated with the heat reclaimed coils and their associated structure diminishes the savings resulting from the increased operating efficiencies.

It is a broad object of the present invention to provide a combined environmental and refrigeration system for use in a supermarket, or the like, for refrigerating the interior of display cases and freezers, and for conditioning the interior space of the supermarket.

It is another object of the present invention to provide a combined environmental and refrigeration system in which the efficiency of the system is increased by substantially reclaiming the heat rejected by the refrigeration system during the environmental system dehumidification mode and heating modes.

It is still another object of the present invention to provide a combined environmental and refrigeration system in which the efficiency of the system is increased by sub-cooling the refrigeration system working fluid during the environmental system dehumidification mode and heating modes.

It is yet another object of the present invention to provide a combined environmental and refrigeration system in which the refrigeration system condenser is located in the environmental system thereby eliminating the need for heat reclaim coils and their associated valves and piping.

SUMMARY OF THE INVENTION

A combined environmental and refrigeration system includes a condenser connected to a refrigeration system with the condenser divided into a main section and a sub-cooler section. A first air flow conducting means is provided to conduct a flow of space air from a conditioned space to and over the main section to heat the space air and then return it to the conditioned space. A second air flow conducting means is provided to conduct a flow of outside air to and over the sub-cooler and sub-cool the refrigeration system working fluid.

The overall system efficiency is increased by heating the space air with heat reclaimed from the refrigeration system and sub-cooling the refrigeration system working fluid.

DESCRIPTION OF THE FIGURES

The above description, as well as the objects, features, and advantages, of the present invention will be more fully appreciated by reference to the following detailed description of a presently preferred but nonetheless illustrative embodiment in accordance with the present invention, when taken in connection with the accompanying drawing wherein.

DESCRIPTION OF THE PREFERRED EMBODIMENT

Figure 1A:
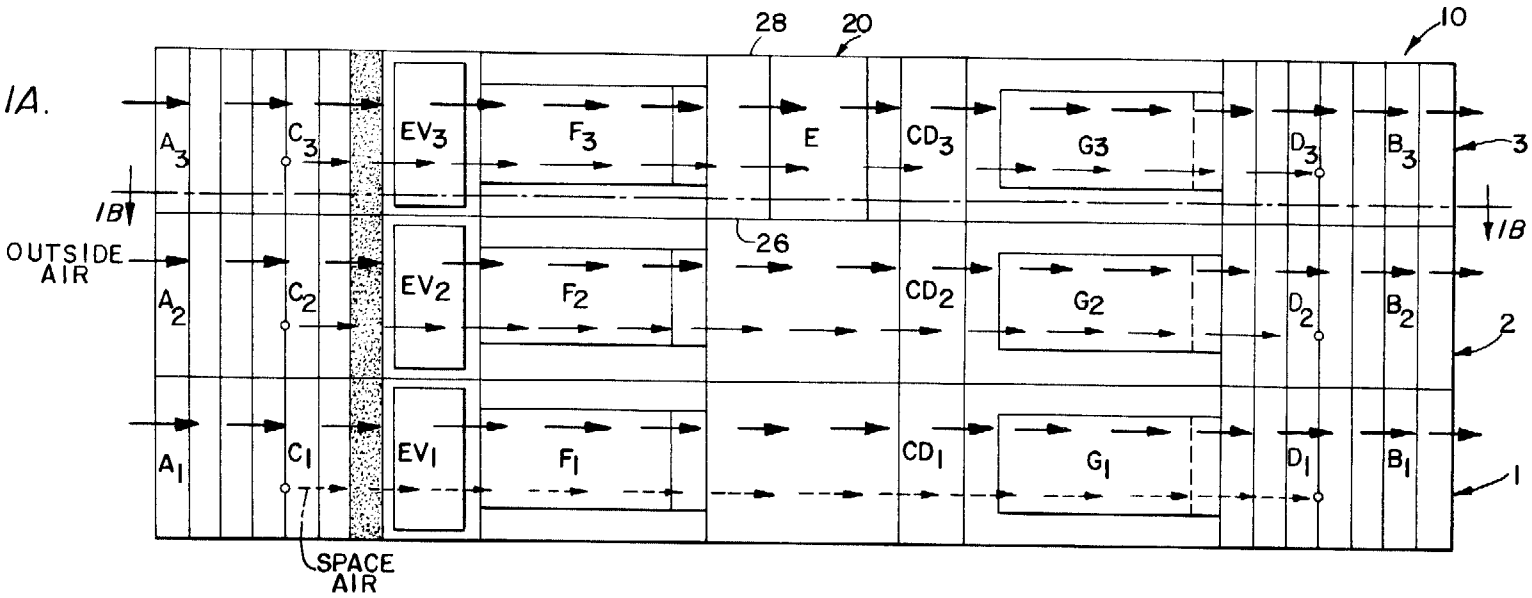
FIG. 1A is a plan view, in cross-section, of a plurality of environmental and refrigeration system modules in accordance with the present invention mounted in a side-by-side relation and operating in a cooling mode.
Figure 1B:
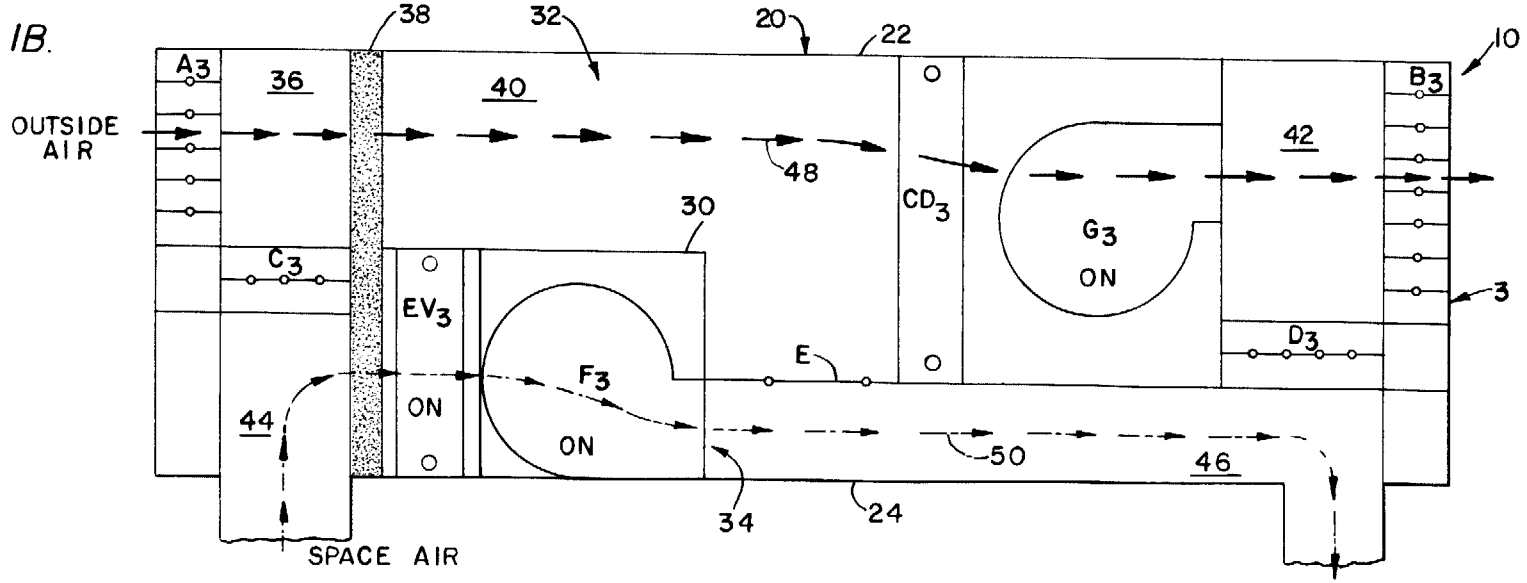
FIG. 1B is a side elevational view, in cross-section, of the modules shown in FIG. 1A, taken along line 1B—1B of FIG. 1A.

As shown in FIGS. 1A and 1B, the reference character 10 refers in general to a combined environmental and refrigeration system in accordance with the present invention which includes a plurality of substantially similar environmental and refrigeration modules 1, 2, and 3 arranged in a side-by-side relationship. The present invention is suitable for use in a supermarket to condition the interior space of the supermarket and to cool the interior space of various display cases and cabinets. The preferred embodiment is preferably mounted on the supermarket roof with various ducts and associated structure leading to and from the conditioned space within the interior of the supermarket. Each of the modules 1, 2 and 3 includes a plurality of components, described in detail below, which are identified herein by reference letters. When referring to a component in a general manner, the appropriate reference letter will be used; and when referring to a component in a specific module, both the reference letter and the module reference numeral will be used. Since the various modules are similar, a detailed description of one of the modules, module 3, is provided with the understanding that the description is applicable to the modules 1 and 2.

The module 3 is enclosed by a sheet metal housing 20 having a top wall 22, bottom wall 24, and side walls 26 and 28. The module 3 is divided by a partition 30 into an upper hot deck compartment, generally designated by the reference character 32, and a lower cold deck compartment, generally designated by the reference character 34. The hot deck compartment 32 includes an outside air inlet damper A3, and inlet air plenum 36, an air filter 38, a filtered air plenum 40, a condenser CD3, an exhaust fan G3, an exhaust air plenum 42, and an exhaust air damper B3. The cold deck compartment 34 includes a space air inlet duct 44, the air filter 38, an evaporator EV3, a fan F3, and a space air return duct 46. A damper C3 is provided between the space air inlet duct 44 of the cold deck compartment 34 and the inlet air plenum 36 of the hot deck compartment 32, and a damper D3 is provided between the exhaust air plenum 42 of the hot deck compartment 32 and the space air return duct 46 of the cold deck compartment 34. In addition, a damper E is provided in module 3 between the filtered air plenum 40 of the hot deck compartment 32 and the horizontal portion of the space air return duct 46 of the cold deck compartment 34.

Each of the dampers is provided with an actuating means (not shown) to actuate the dampers between a closed position in which the flow of air is substantially blocked and an open position in which air flows freely from one side of the damper to the other. The actuating means may comprise, for example, a spring to resiliently bias the damper to the closed position, and an electromagnatic actuator coupled to the damper which is adapted to open the damper when energized. The various dampers may be controlled to provide a plurality of air flow modes as described below. In the drawings, air flow in the hot deck compartment 32 is represented by the solid line arrows 48, while air flow in the cold deck compartment 34 is represented by the dashed line arrows 50.

Figure 2A:
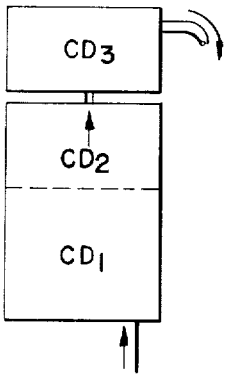
FIG. 2A is a schematic plan view of an alternate condenser arrangement for the refrigeration system shown in FIG. 2.
Figure 2B:
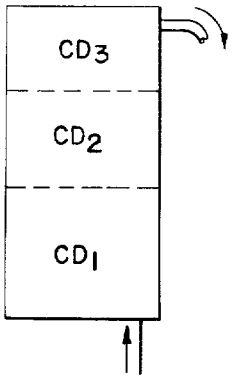
FIG. 2B is a schematic plan view of another alternate condenser arrangement for the refrigeration system shown in FIG. 2.
Figure 2:
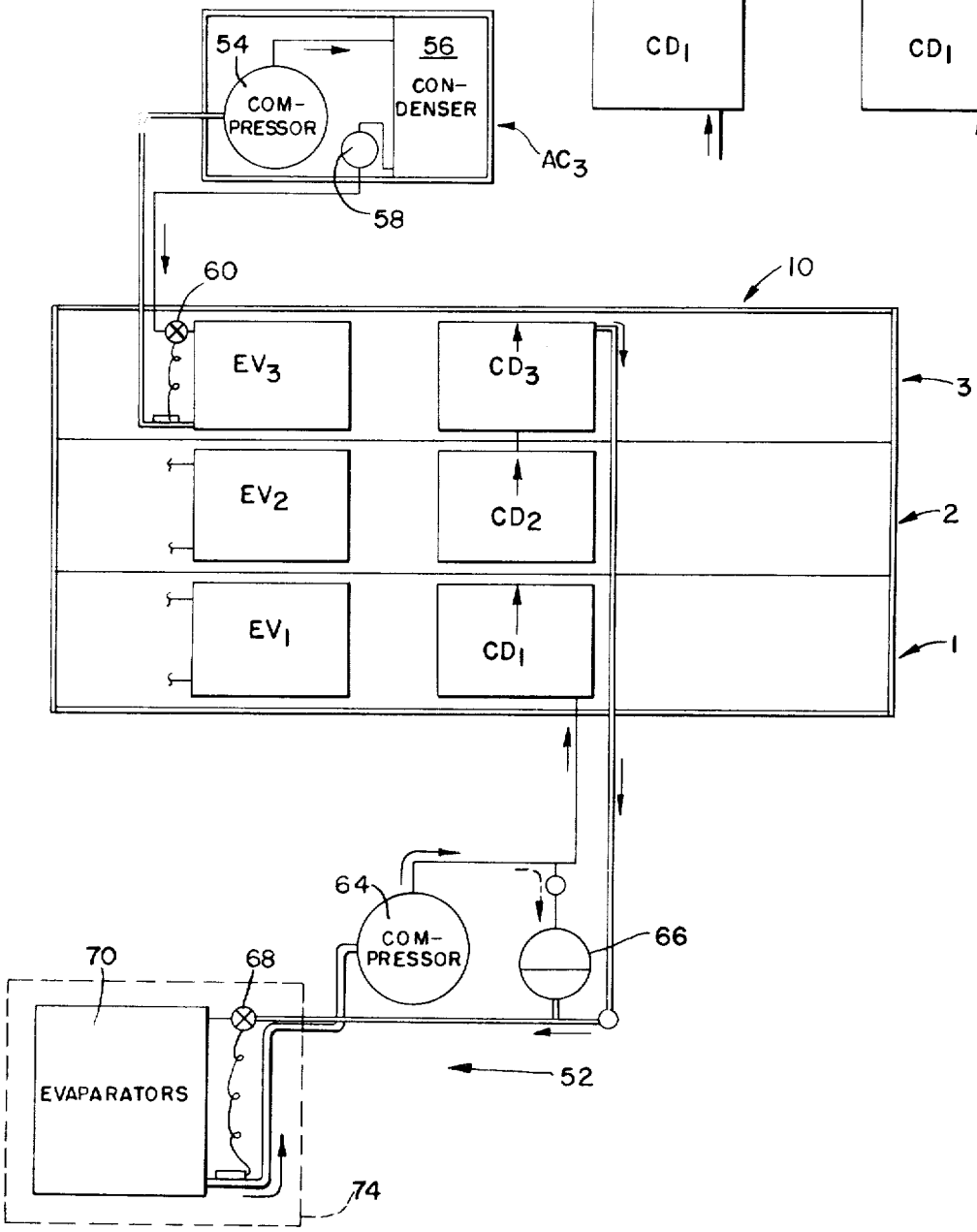
FIG. 2 is a schematic plan view of the modules shown in FIG. 1A connected by suitable piping to an environmental air conditioning system and to a refrigeration system.

As shown in FIG. 2, the module 3 is connected to an air conditioning system, generally designated by the reference character AC3, and to a refrigeration system, generally designated by the reference character 52. While only the evaporater EV3 is shown connected to the air conditioning system AC3, it is to be understood that both the evaporators EV1 and EV2 are similarly connected to air conditioning systems AC1 and AC2 (not shown) substantially identical in structure to the air conditioning system AC3. In the preferred embodiment, the air conditioning systems AC1, AC2, and AC3, and the refrigeration cooling unit 52 are remotely located from the system 10.

The air conditioning system AC3 is of conventional design and includes a compressor 54, a condenser 56, a receiver 58, an expansion valve 60, and the evaporator EV3 located in the module 3 connected together by suitable tubing to form an air conditioning circuit. The air conditioning system AC3 operates through a conventional air conditioning cycle with the compressor 54 compressing the working fluid and passing it through the condenser 56, the receiver 58, the expansion valve 60, and the evaporator EV3.

The refrigeration system 52 includes a compressor 64, the condensers CD1, CD2, and CD3 located in the system 10, a surge receiver 66, an expansion valve 68, and an evaporator 70 connected together by suitable tubing to form a refrigeration circuit.

The evaporator 70 and its associated expansion valve 68 are located within a refrigerated display case represented by the broken-line enclosure 74 of FIG. 2. While only one evaporator 70 and display case 74 combination has been shown, it is to be understood that the refrigeration system 52 may include a plurality of evaporators located within respective display cases.

As shown in FIG. 2, the condensers CD1, CD2, and CD3 are connected in series such that the refrigeration system working fluid must first flow through the condensers CD1 and CD2 before it passes through the condenser CD3. The condensers CD1 and CD2 constitute a main section and the condenser CD3 constitutes a sub-cooler section. Alternate arrangements for the refrigeration system condenser are shown in FIG. 2A and 2B. In FIG. 2A, the condensers CD1 and CD2 are combined as a single condensing structure which is connected in series with the sub-cooling condenser CD3. In FIG. 2B, the condensers CD1, CD2, and CD3 are combined as a single condenser havng an internal flow arrangement such that the portion of the condenser in module 3 functions as the sub-cooler.

The refrigeration system 52 operates in a conventional manner with the compressor 64 compressing the refrigeration system working fluid, passing it through the condensers CD1, CD2, and CD3, and through the various expansion valves 68 and evaporators 70. Heat in the interior of the display cases 74 is absorbed by the evaporators 70 and transferred to the condensers CD1, CD2, and CD3.

The environmental and refrigeration system 10 is adapted to operate in a plurality of modes including a conditioned space dehumidification mode and a plurality of cooling and and heating modes. These modes, described below, are entered by controlling the various fans, evaporators, and selectively opening or closing the various dampers. Table A sets forth the various operating modes for the system 10 and the required position or operating state for the various dampers, fans, and evaporators.

Figure 3:
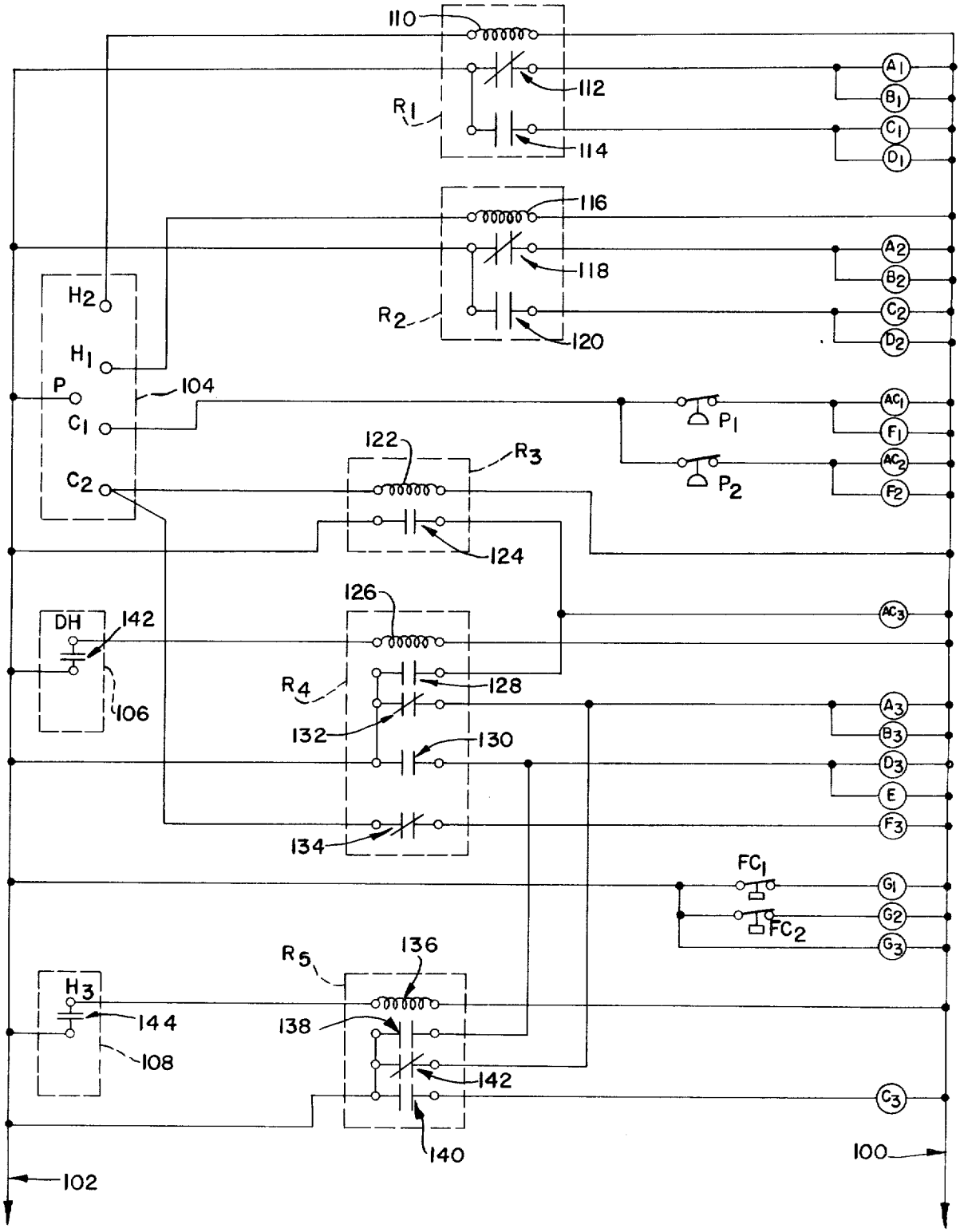
FIG. 3 is a diagram of an electrical circuit for controlling the various operating modes of the apparatus shown in FIGS. 1A, 1B, and 2.

The system 10 is placed in its various operating modes by means of the electrical circuitry illustrated in FIG. 3. While the circuitry of FIG. 3 utilizes conventional electrical switches and electro-mechanical relays, the various operating modes can be also achieved by electronic circuitry, including combinational and sequential logic devices, and thyristors such as SCR's and TRIAC's.

The circuitry illustrated in FIG. 3 includes first and second power leads, 100 and 102, with each of the various components having one side thereof connected directly to the power lead 100 as shown on the right side of FIG. 3; and the other side thereof connected the power lead 102 through a mode selection switch 104, various relays R1–R5, and controllers 106 and 108. The mode selection switch 104 is a four-position switch having first and second cooling mode positions, and first and second heating mode positions. The switch 104 includes a terminal pin P, connected to the power lead 102, which may selectively be connected to a terminal pin H1 for first stage heating, a terminal pin H2 for second stage heating, or a terminal pin C1 for a first stage cooling and a terminal pin C2 for second stage cooling.

The coil 110 of a first relay R1 is connected between the terminal pin H2 and the power lead 100 with the normally closed (NC) contacts 112 and the normally opened (NO) contacts 114 of the relay R1 controlling, respectively, the module 1 inlet air and exhaust air dampers A1 and B1, and the module 1 dampers CL and D1.

The coil 116 of a second relay R2 is connected between the terminal pin H1 and the power lead 100 with the normally closed (NC) contacts 118 and the normally open (NO) contacts 120 of the relay R2 controlling, respectively, the module 2 input air and exhaust air dampers A2 and B2, and the dampers C2 and D2.

Pressure responsive switches P1 and P2 are connected between the terminal pin C1 and, respectively, the module 1 air conditioning system AC1 and fan F1, and the module 2 air conditioning system AC2 and fan F2.

The coil 122 of a third relay R3 is connected between the terminal pin C2 and the power lead 100 with the normally opened (NO) contacts 124 controlling the module 3 air conditioning system AC3.

The coil 126 of a relay R4 is connected between a dehumidification controller 106 and the power lead 100 with the normally opened (NO) contacts 128 and 130 controlling, respectively, the module 3 air conditioning system AC3, and the dampers D3 and E; and with the normally closed (NC) contacts 132 and 134 controlling, respectively, the module 3 inlet air and exhaust air dampers A3 and B3, and the fan F3.

The fans G1 and G2 are connected between the power leads 100 and 102 through fan controllers FC1 and FC2, and the fan G3 is permanently connected between the power leads 100 and 102 for continuous operation as shown.

The coil 136 of a relay R5 is connected between the third stage heat controller 108 and the power lead 100 with the normally opened (NO) contacts 138 and 140 controlling, respectively, the module 3 dampers D3, E, and C3; and the normally closed (NC) contacts 142 controlling the dampers A3 and B3.

COOLING MODES

The system 10 is operable in either a first stage or a second stage cooling mode as set forth in Table A. In the first stage cooling mode, the air conditioning units for modules 1 and 2 cycle on and off in response to the requirements of the conditioned space, and, in the second stage cooling mode, the air conditioning units for all three modules 1, 2, and 3 operate in an uninterrupted manner to cool the space air.

The system 10 is shown operating in the second stage cooling mode in FIGS. 1A and 1B. As shown therein, the inlet air dampers A1–A3 and the exhaust air dampers B1–B3 are in the open position. The fans G1–G3 draw outside air, respectively, through the filter 38, over the condensers CD1–CD3 where it is heated, and through the exhaust air dampers B1–B3 thereby removing the heat from the refrigeration system. Also, the fans F1–F3 draw space air from the conditioned space through the space air inlet ducts 44, through the air filter 38, and over the evaporators EV1–EV3. The filtered and cooled space air is then returned to the conditioned space through the return air ducts 46. In both the first and second stage cooling modes, the dampers C1–C3, D1–D3, and E are closed to prevent air flow communication between the hot deck compartment 32 and the cold deck compartment 34. As shown in Table A, the first stage cooling mode is similar to the second stage cooling mode, except that the fan F3 and the evaporator EV3 of the module 3 are off; and the evaporators EV1 and EV2 of the modules 1 and 2 and their respective fans F1 and F2, are cycled on and off in response to the temperature of the conditioned space air as detected by pressure responsive switches P1 and P2.

As shown in FIG. 3, the system 10 may be placed in the first stage cooling mode, as set forth in Table A, by completing the circuit between the terminal pins P and C1 of the mode selection switch 104 to cause the air conditioning system AC2 and AC3 and their respective fans F2 and F3 to cycle on and off in response to the switches P1 and P2. In this mode, the module 2 inlet air and exhaust air dampers A2 and B2 are open, and the dampers C2 and D2 are closed.

The second stage cooling mode may be entered by additionally completing the circuit between the terminal pin P and C2 to energize the relay coil 122 of relay R3 to cause the normally opened (NO) contacts 124 to close energizing the air conditioning system AC3, and its fan F3 through the normally closed (NC) contacts 134 of the relay R4. In the second stage cooling mode, the module 3 inlet air and exhaust air dampers A3 and B3 are maintained in the closed position, and the dampers C3 and D3 and E are closed.

DEHUMIDIFICATION MODE

Figure 4A:
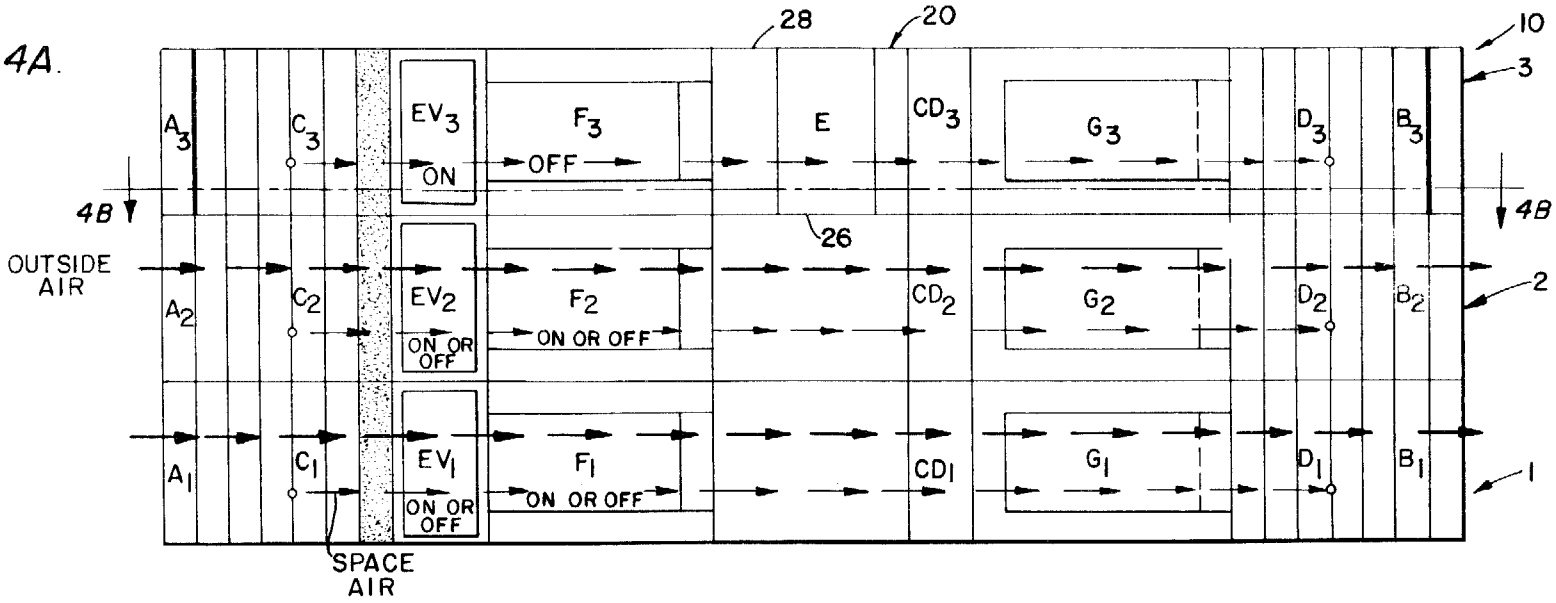
FIG. 4A is a plan view, in cross-section, of the environmental and refrigeration system modules shown in FIG. 1A operating in a dehumidification mode.
Figure 4B:
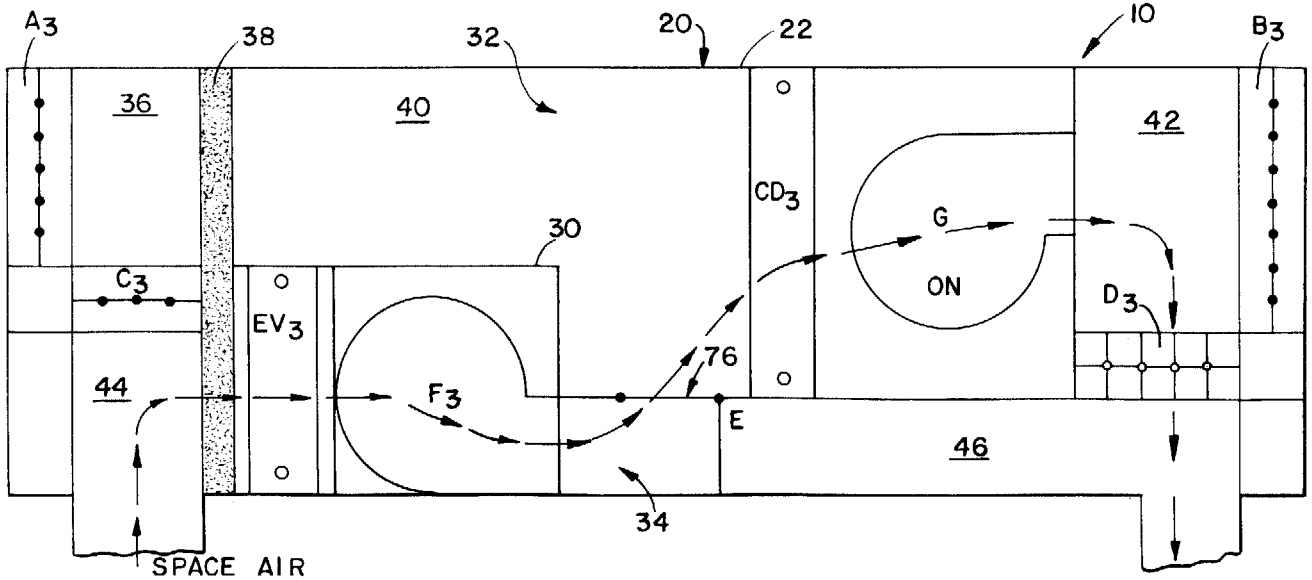
FIG. 4B is a side elevational view, in cross-section, of the modules shown in FIG. 4A, taken along line 4B–4B of FIG. 4A.

The system 10 may be operated in a dehumidification mode, as set forth in Table A, and as shown in FIGS. 4 and 4B. In the dehumidification mode, the module 3 operates to dehumidify the air from the conditioned space while the modules 1 and 2 may be off, in the first stage cooling mode, or in the second stage cooling mode. In this mode, the outside air inlet damper A3, the exhaust damper B3 and the damper C3 are closed, the damper D3 is open, and the dehumidification damper E is in its down position to block the flow of air in the horizontal portion of the space air return duct 46. When the damper E is in its down position, an opening is provided between the cold deck compartment 34 and the hot deck compartment 32. Air from the conditioned space is drawn into the space air inlet duct 44, through the filter 38, through the evaporator EV3 where the air is cooled to lower its moisture content, and through the opening 76 to the condenser CD3 where the air is reheated. The fan G3 then directs the dehumidified space air into the exhaust air plenum 42 and through the open damper D3 to the space air return duct 46 and then to the conditioned space.

The dehumidification mode removes moisture from the space air and increases the overall operating efficiency of the system 10 by dehumidifying the space air in the evaporator EV3 of the higher efficiency air conditioning system AC3 and then reheating the dehumidified air with the heat rejected from the refrigeration system 52. The cooled, dehumidified air, drawn through the sub-cooling condenser CD3 sub-cools the working fluid of the refrigeration system to thereby increase the refrigeration system efficiency.

As shown in FIG. 3, the environmental and refrigeration system 10 is placed in the dehumidification mode by causing the normally opened (NO) contacts 142 of the dehumidification controller 106 to close to complete the circuit to the coil 126 of the relay R4. The normally open (NO) contacts 128 and 130 of the relay R4 are closed completing the circuit, respectively, to the air conditioning unit AC3 and the module 3 dampers D3 and E to open the damper D3 and move the E damper to its down position. The normally closed (NC) contacts 132 and 134 of the relay R4 are opened interrupting the power to the module 3 inlet air and exhaust air dampers A3 and B3 causing these dampers to close.

HEATING MODES

The system 10 is operable in one of three available heating modes in which the space air temperature is elevated relative the outside air temperature and in which the air conditioning units AC1, AC2, and AC3 are off as set forth in Table A. In the first stage heating mode, the module 2 functions to heat the space air; in the second stage heating mode the modules 1 and 2 heat the space space air; and in the third stage heating mode all three modules 1, 2, and 3 heat the space air.

Figure 5A:
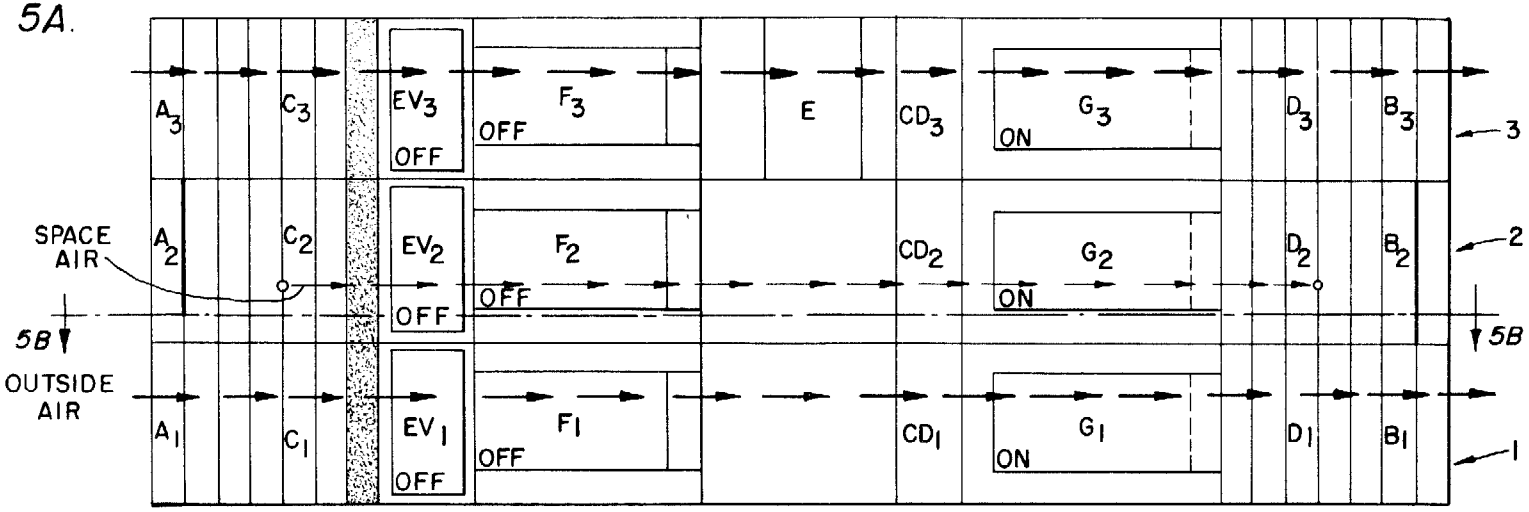
FIG. 5A is a plan view, in cross-section, of the environmental and refrigeration system modules shown in FIG. 1A operating in a heating mode.
Figure 5B:
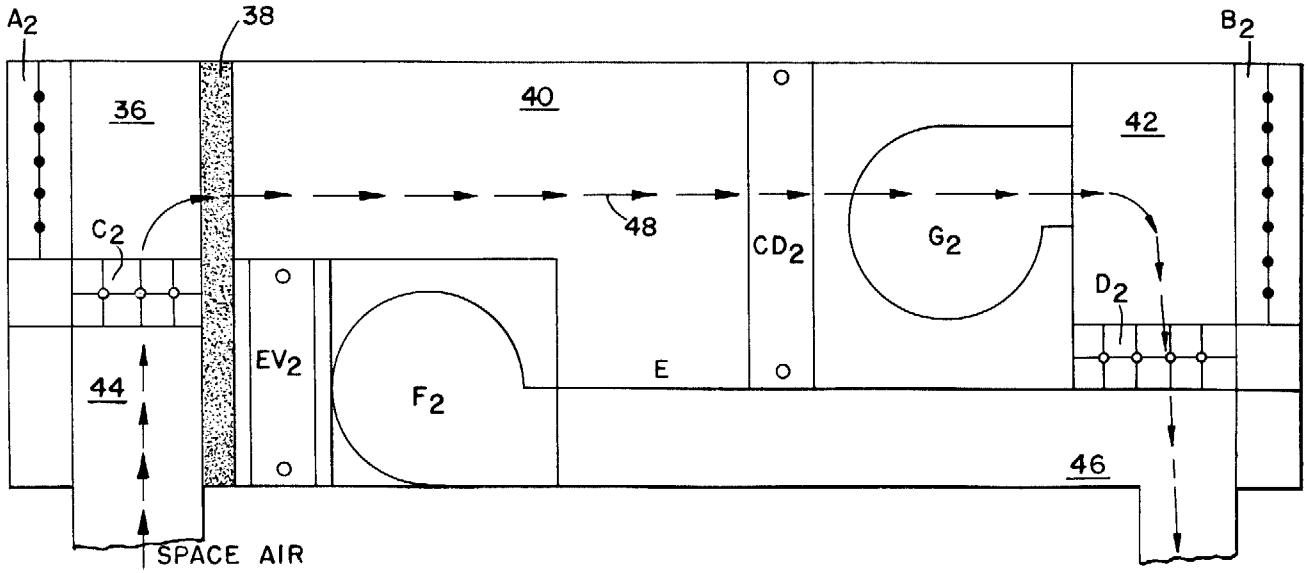
FIG. 5B is a side elevational view, in cross-section, of the modules shown in FIG. 5A, taken along lines 5B—5B of FIG. 5A.

The system 10 is shown operating in a first stage heating mode in FIG. 5A and 5B in which the module 2 inlet air exhaust air dampers A2 and B2 are closed and the dampers C2 and D2 are open. Air flows from the conditioned space through the space air inlet duct 44, through the filter 38 into the filtered air plenum 40, through the condenser CD2 where the air is heated, through the fan G2, and into the exhaust air plenum 42 and through the opened damper D2 to the conditioned space. By heating the conditioned space air in this manner, a substantial amount of the heat rejected by the refrigeration system condenser CD2 is reclaimed, thereby increasing the efficiency of the refrigeration system. While the module 2 is operating as described, the modules 1 and 3 are operating with their respective inlet air and exhaust air dampers A1, B1 and A3, B3 open and with their respective dampers C1, D1 and C3, D3, and E in the closed position as set forth in Table A. The fans G1 and G3 draw cold outside air through the inlet air dampers A1 and A3, the inlet air plenums 36, filter 38, the filtered air plenums 40 and through the condensers CD1 and CD3. The cool air flowing over condensers CD1 and CD3 is heated thereby and exhausted by the fans G1 and G3 to the outside through the open exhaust air dampers B1 and B3. As can be appreciated, the cold outside air flowing over the sub-cooling condenser CD3 serves to sub-cool the refrigerant system working fluid thereby increasing the efficiency of the refrigeration system 52.

In the second stage heating mode, modules 1 and 2 are operated with their respective inlet air and exhaust air dampers A1, B1, and A2, B2 closed and with their dampers C1, C2, and D1, D2 open. In the third stage heating mode, all three modules are operated with their respective inlet air and exhaust air dampers A1, A2, A3, and B1, B2, B3 closed, and their dampers C1, C2, C3 and D1, D2, D3 opened.

As shown in FIG. 3, the system 10 may be operated in the first stage heating mode by completing the circuit in the mode selection switch 104 between the terminal pins P and H1 to energize the coil 116 of the relay R2. The normally closed (NC) contacts 118 are opened thereby closing the module 2 inlet air and exhaust air dampers A2 and B2 and closing the normally second (NO) contacts 120 to open the dampers C2 and D2. The fan G2 operates in response to the fan controller FC2.

In order to enter the second stage heating mode, the circuit in the mode selection switch 104 between the terminal pins P and 2H is additionally completed to energize the coil 110 of the relay R1. The normally closed (NC) contacts 112 are opened to close the inlet air and exhaust air dampers A1 and B1, and the normally opened (NO) contacts 114 are closed to open the dampers C1 and D1. The fan G1 then operates in response to its fan controller FC1.

In order to enter the third stage heating mode, the normally (NO) contacts 144 of the third stage heat controller 108 are closed completing the circuit to the coil 136 of relay R5. The normally opened (NO) contacts 138 and 140 are closed to, respectively, open the damper D3 and move the damper E to its down position. The normally closed (NC) contacts 142 are opened to cause the inlet air and exhaust air dampers A3 and B3 to close. In the third stage heating mode, essentially all the heat rejected by the refrigeration system 52 is reclaimed. The space air flowing through the hot deck compartment 32 of the module 3 sub-cools the refrigerant system 52 working fluid to increase the efficiency of the refrigeration system.

NO HEAT—NO COOLING

The system 10 may be placed in a no heat—no cooling mode as set forth in Table A. In this mode, all the inlet air dampers A1–A3 and all the exhaust air dampers B1–B3 are open, and all the dampers C1–C3 and D1–D3 are closed. In addition, all the evaporators EV1–EV3 and their respective fans F1–F3 are off. The hot deck fan G3 is on with the fans G1 and G2 cycling on and off in response to their respective controllers FC1 and FC2.

As can be appreciated, the environmental and refrigeration system of the present invention permits precise four season control of the conditioned space within, for example, a supermarket, and the refrigeration of the interior of display cases while substantially reclaiming the heat rejected by the refrigeration system, sub-cooling the refrigeration system working fluid, and dehumidifying the conditioned space air using the higher efficiency air conditioning system.

As will be apparent to those skilled in the art, various changes and modifications may be made to the system of the present invention without departing from the spirit and scope of the present invention as recited in the appended claims and legal equivalent.

TABLE A

| | | SYSTEM OPERATING MODES | | | | | | |
|---|---|---|---|---|---|---|---|---|
| | | First Stage Cooling | Second Stage Cooling | Dehumidification | First Stage Heating | Second Stage Heating | Third Stage Heating | No Heat No Cooling |
| INLET DAMPER | A1 | Open | Open | Open | Open | Closed | Closed | Open |
| INLET DAMPER | A2 | Open | Open | Open | Closed | Closed | Closed | Open |
| INLET DAMPER | A3 | Open | Open | Closed | Open | Open | Closed | Open |
| EXHAUST DAMPER | B1 | Open | Open | Open | Open | Closed | Closed | Open |

TABLE A-continued

| | | SYSTEM OPERATING MODES | | | | | | |
|---|---|---|---|---|---|---|---|---|
| | | First Stage Cooling | Second Stage Cooling | Dehumidification | First Stage Heating | Second Stage Heating | Third Stage Heating | No Heat No Cooling |
| EXHAUST DAMPER | B2 | Open | Open | Open | Closed | Closed | Closed | Open |
| EXHAUST DAMPER | B3 | Open | Open | Closed | Open | Open | Closed | Open |
| DAMPER | C1 | Closed | Closed | Closed | Closed | Open | Open | Closed |
| DAMPER | C2 | Closed | Closed | Closed | Open | Open | Open | Closed |
| DAMPER | C3 | Closed | Closed | Closed | Closed | Closed | Open | Closed |
| DAMPER | D1 | Closed | Closed | Closed | Closed | Open | Open | Closed |
| DAMPER | D2 | Closed | Closed | Closed | Open | Open | Open | Closed |
| DAMPER | D3 | Closed | Closed | Open | Closed | Closed | Open | Closed |
| DEHUMIDIFICATION DAMPER | E | Up | Up | Down | Up | Up | Down | Up |
| COLD DECK FAN | F1 | On* | On | On** | Off | Off | Off | Off |
| COLD DECK FAN | F2 | On* | On | On** | Off | Off | Off | Off |
| COLD DECK FAN | F3 | Off | On | Off | Off | Off | Off | Off |
| HOT DECK FAN | G1 | On | On | On | On | On | On | On* |
| HOT DECK FAN | G2 | On | On | On | On | On | On | On* |
| HOT DECK FAN | G3 | On | On | On | On | On | On | On |
| COLD DECK EVAP. (AC1) | EV1 | On* | On | On** | Off | Off | Off | Off |
| COLD DECK EVAP. (AC2) | EV2 | On | On | On** | Off | Off | Off | Off |
| COLD DECK EVAP. (AC3) | EV3 | Off* | On | On | Off | Off | Off | Off |

*Will cycle on pressure control or fan cycling control.
**Depends on the cooling requirement.

We claim:

1. An environmental and refrigeration system for supplying conditioned air to a conditioned space comprising:

a condenser connected to a refrigeration system for condensing a refrigeration system working fluid, said condenser having a main section and a sub-cooler section connected together in continuous series flow, the refrigeration system working fluid adapted to pass through said main section and then through said sub-cooler section;

an evaporator connected to an air conditioning system for evaporating an air conditioning system working fluid;

first air flow controlling means for selectively passing a flow of space air from a conditioned space over at least a portion of said main section and/or over said evaporator and for passing outside air from the environment over said sub-cooler;

second air flow controlling means for selectively passing air from said condenser to said conditioned space or said environment;

said first air flow controlling means configured, when said environmental and refrigeration system is in a heating mode, to pass space air over at least a portion of said main section to thereby heat the space air with heat reclaimed from said refrigeration system and to pass outside air over said sub-cooler section to sub-cool said refrigeration system working fluid; and said second air flow controlling means configured, when said environmental and refrigeration system is in the heating mode, to return the heated space air from said main section to the conditioned space, and to return the outside air from said sub-cooler to the environment.

2. The environmental and refrigeration system claimed in claim 1, wherein said refrigeration system includes at least one evaporator located within a refrigerated display case.

3. The environmental and refrigeration system claimed in claim 1, wherein said first air flow controlling means is adapted to pass the flow of space air over the entire main section.

4. The environmental and refrigeration system claimed in claim 1, wherein said first air flow controlling means comprises:

a space air inlet damper located on an upstream side of said condenser and evaporator for passing space air to said main section or said evaporator; and an outside air inlet damper located on the upstream side of said condenser for selectively passing outside air to said sub-cooler.

5. The environmental and refrigeration system claimed in claim 4, further comprising:

a main section fan located upstream of said condenser adapted to direct outside air from said outside air inlet damper and/or space air from said space air inlet damper to said condenser; and an evaporator fan located upstream of said evaporator and adapted to direct space air from said space air inlet damper to said evaporator.

6. The environmental and refrigeration system claimed in claim 4, wherein said second air flow controlling means comprises:

a space air return damper located on the downstream side of said main section for passing air from said main section to the conditioned space; and an exhaust air damper located on the downstream side of said sub-cooler for passing air from said sub-cooler to the environment.

7. The environmental and refrigeration system claimed in claim 1, wherein said space air flow and said outside air flow are parallel to one another and in the same direction.

8. The environmental and refrigeration system claimed in claim 1, wherein said environmental and refrigeration system is divided into a hot deck compartment and a cold deck compartment and further sub-divided into a first module having a portion of said hot and cold deck compartments and at least one other module having the remaining portion of said hot and cold deck compartments;

said hot deck compartment of said first module containing said main section; said hot deck compartment of said second module containing said sub-cooler; and at least one of said cold deck compartment modules containing said evaporator.

9. The environmental and refrigeration system claimed in claim 8, wherein said first and said second modules are located in adjacent side-by-side relation.

10. An environmental and refrigeration system for supplying conditioned air to a conditioned space comprising:

a condenser connected to a refrigeration system for condensing a refrigeration system working fluid, said condenser having a main section and a sub-cooler section connected together in continuous series flow, the refrigeration system working fluid adapted to pass through said main section and then through said sub-cooler section;

an evaporator connected to an air conditioning system for evaporating an air conditioning system working fluid;

a first air flow conducting means for passing a flow of space air from a conditioned space over said evaporator to dehumidify and cool the space air, and over said sub-cooler to reheat the space air with heat reclaimed from the refrigeration system and sub-cool the refrigeration system working fluid, and for returning the dehumidified space air to the conditioned space;

a second air flow conducting means for passing a flow of air from the outside environment over at least a portion of said main section.

11. The environmental and refrigeration system claimed in claim 10, wherein said refrigeration system further comprises;

at least one evaporator located in a refrigerated display case.

12. The environmental and refrigeration system claimed in claim 10, wherein the flow of outside air passing over said main section is exhausted to said outside environment.

13. The environmental and refrigeration system claimed in claim 10, wherein the second air flow conducting means passes said flow of outside air over the entire main section.

14. The environmental and refrigeration system claimed in claim 10, wherein said first air flow conducting means comprises:

a space air inlet duct located on one side of said evaporator for conducting space air to said evaporator;

a space air return duct located on one side of said sub-cooler for conducting air from said sub-cooler; and a fan intermediate said space air inlet duct and said return air duct to cause a flow of space air from the conditioned space along said inlet air duct, over said evaporator, over said sub-cooler, and along said return air duct to the conditioned space.

15. The environmental and refrigeration system claimed in claim 14, further comprising:

an outside air inlet damper located on one side of said main section;

an exhaust air damper located on the other side of said main section; and a main section fan intermediate said inlet air and said exhaust air dampers for causing a flow of outside air over said main section.

16. The environmental and refrigeration system claimed in claim 15, further comprising;

a hot deck compartment having said condenser mounted therein;

a cold deck compartment having said evaporator mounted therein;

said space air inlet air duct located on an upstream side of said evaporator for conducting a flow of space air over said evaporator;

said return air duct located on a downstream side of said sub-cooler for conducting air from said sub-cooler to said conditioned space; and a dehumidification damper between said hot deck compartment and said cold deck compartment to direct air from the downstream side of said evaporator to the upstream side of said sub-cooler.

17. The environmental and refrigeration system claimed in claim 16, wherein:

said hot deck compartment is divided into at least two modules with said main section mounted in a first module and sub-cooler section mounted in a second module;

said first air flow conducting means are associated with said first module; and said second air for conducting means are associated with said second module.

* * * * *